United States Patent [19]

Riekkinen et al.

[11] 4,369,928

[45] Jan. 25, 1983

[54] APPARATUS FOR FORMING A LONG LEADING END IN A WIRE WHEN WINDING SAID WIRE ON A REEL

[75] Inventors: Asko S. Riekkinen, Kirkkonummi; Allan F. Rönneberg, Helsinki, both of Finland

[73] Assignee: Oy Nokia AB, Helsinki, Finland

[21] Appl. No.: 206,262

[22] Filed: Nov. 12, 1980

[30] Foreign Application Priority Data

Nov. 12, 1979 [FI] Finland ..... 793539

[51] Int. Cl.[3] ..... B65H 54/02

[52] U.S. Cl. ..... 242/25 A

[58] Field of Search ..... 242/25 A, 25 R, 18 A, 242/18 PW

[56] References Cited

U.S. PATENT DOCUMENTS

| | | | |
|---|---|---|---|
| 2,546,636 | 3/1951 | Hanson et al. | 242/25 A |
| 3,441,229 | 4/1969 | Henrich | 242/25 A |
| 3,698,652 | 10/1972 | Morikawa et al. | 242/25 A |
| 3,701,491 | 10/1972 | Brown | 242/25 A |
| 3,877,653 | 4/1975 | Foltyn et al. | 242/25 A |

FOREIGN PATENT DOCUMENTS

| | | | |
|---|---|---|---|
| 1168732 | 4/1964 | Fed. Rep. of Germany | 242/25 A |
| 2529764 | 1/1976 | Fed. Rep. of Germany | 242/25 A |
| 48-29380 | 4/1973 | Japan . | |

*Primary Examiner*—Stanley N. Gilreath
*Attorney, Agent, or Firm*—Finnegan, Henderson, Farabow, Garrett & Dunner

[57] ABSTRACT

An apparatus for forming a long leading end in a wire wound on a reel in a winding machine comprising at least one power driven shaft for rotating a reel and a shifting flange positioned at one side of said reel. The shifting flange is provided with means for gripping the leading end of the wire when starting the winding of the wire on said reel. The apparatus comprises a gear mechanism coupled between the reel shaft (11) and the shifting flange (7) which gear mechanism rotates said shifting flange with a rotation speed lower than the rotation speed of the reel. The gear mechanism is provided with coupling means (17) for selectively connecting and disconnecting said gear mechanism and the shifting flange is coupled by means of a friction clutch so that said shifting flange slides on the reel shaft when the gear mechanism is connected but is driven by said reel shaft when the gear mechanism is disconnected. The gear mechanism is connected under a predetermined number of revolutions of the reel at the beginning of the winding on the reel in order to wind the leading end of the wire as one or several loops considerably larger than the wire windings on the reel and thereby to obtain a long free leading end in the wire wound on the reel.

3 Claims, 4 Drawing Figures

Figure 1:
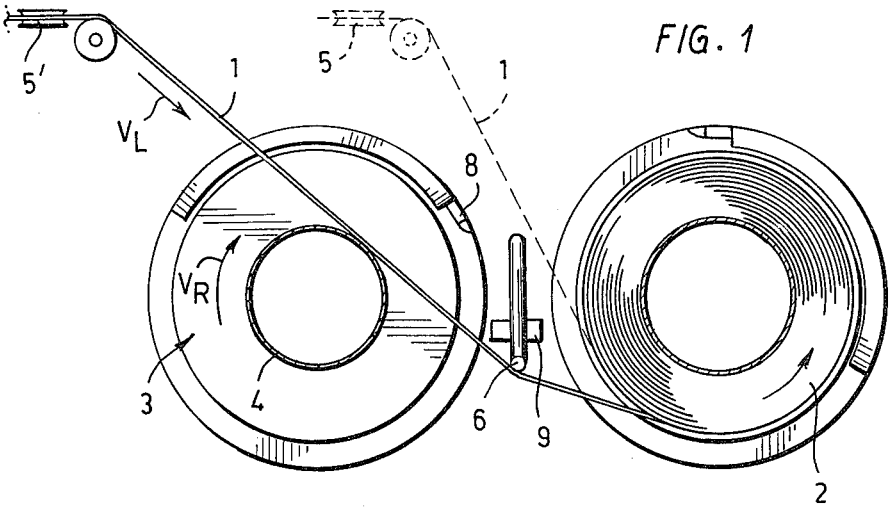

5'
5
1
1
$V_L$
8
$V_R$
3
4
6
9
2

21
11
16
18
15
17
13
19
6
5'
7
20
14
12
10
A
A
5
3
4
2

APPARATUS FOR FORMING A LONG LEADING END IN A WIRE WHEN WINDING SAID WIRE ON A REEL

The present invention relates to an appratus which is used when winding a wirelike product on a reel and by means of which a long leading end is formed in the wire being wound on the reel. The apparatus is particularly well applicable in connection with a double-winding device.

Double-winding devices have been used for years in the production of cables and bright wires. The most essential feature in double-winding, i.e. a controlled shifting of the wire from a full reel to an empty one, is a method known, for example, from the U.S. Pat. No. 2,546,636. As a reel is refilled, a winding distributor is shifted to such a position that the wire runs close to the drum of an empty reel. Shortly before the moment of shifting the wire, when the wire has reached the shifting side of the reel, a so-called finger presses the wire against a shifting flange whereby the wire engages with gripper element provided in the shifting flange. As the reels rotate in different directions, the wire is ultimately cut off between the gripper element and the full reel.

When unwinding reels in continuous cable-making processes, a plurality of reels are interconnected by welding the trailing end of one cable to the leading end of a second cable. For this operation, a sufficiently long free leading end in the wire on the reel is required. When shifting the wire in the manner described above, the length of the free wire end will be equal to the distance between the gripper element of the shifting flange and the outermost wire turns on a full reel, which distance normally is only about 100 mm. This is due to the fact that the diameter of the shifting flange cannot be made essentially bigger than the diameter of the reel flange. As far as the further handling of reels is concerned, the most appropriate length of the leading end is at least 400 mm.

A method for obtaining an essentially longer wire end has long been known, for example, from the Japanese patent publication No. 48-29380 and from the Finnish Patent publication No. 51,931. According to this patent a free wire end can be made longer by causing the shifting flange, which normally rotates along with the reel, to rotate slightly slower than the rotation speed of the reel when winding is started onto an empty reel. The wire, due to its rigidity and the centrifugal force, assumes an arched position, with one of its ends fastened to the wire layer on the reel and the other end fastened to the gripper element during the entire winding operation. The wire loop formed in this way must be guided into a wire groove to protect it against mechanical damage during the winding operation because the leading end of the wire must be of the same quality as the wire on the reel. As the reel, upon completion of the winding, is released from the winding device, the end of the loop is disengaged from the gripper element, and in this way a long leading wire end is formed whose length depends on the reel diameter and on the extent of the lag (i.e. the magnitude of slower rotation) of the shifting flange. Also other methods for producing a long leading end in a wire are known, for example, from the German Offenlegungsschrift No. 2,165,798.

Both Japanese and Finnish patent publications describe that the lag between the rotation speeds of the shifting flange and of the reel is obtained by braking the rotation speed of the shifting flange. In this way it is, however, extremely difficult to limit the extent of the lag in any other way but by means of mechanical stops.

The attempts to use higher and higher rotation speeds for the reel and the shifting flange and to carry out the change of reels at a full production rate make it difficult to use the braking method for producing a lag in the shifting flange both as far as the machine elements and the control system are concerned because the braking force required for the operation would be needed only during some millesimals of a second. However, it is desirable to obtain a construction which permits the formation of a long leading end in a wire also at high rotation speeds of the reel and of the shifting flange, and an easy control of the lag and thereby also of the length of the leading end of the wire, and the retardation of the speed at which the wire loop is formed so as to positively guide the wire loop into the wire groove for protection during winding. In addition, the long time during which the operation is carried out facilitates the construction of the control system.

This object is achieved by means of an apparatus according to the invention which is characterized in that the shifting flange is caused to lag with respect to the rotation speed of the reel by means of a gear mechanism which is by means of a clutch engaged for a time as long as the long wire end is being formed. This gear mechanism produces for the shifting flange a rotation speed which is less than 1% lower than that of the reel and proportional thereto. Thereby the time for producing the wire loop can, by means of the utilized gear ratio which is close to one, be substantially prolonged. At the same time the construction is no longer depending on the rotation speed of the reel and, therefore, the extent of the lag can be adjusted by changing the time of operation of the device. Because the lag is of a constant magnitude for each revolution of the reel, the lag of the shifting flange in relation of the rotation of the reel can, at any moment during the operation, be controlled by counting the number of revolutions of the reel or of the shifting flange from the beginning of the operation. When the required number of revolutions, i.e. the required lag, is obtained in the counter, the gear mechanism is disengaged by means of the clutch.

Figure 2:
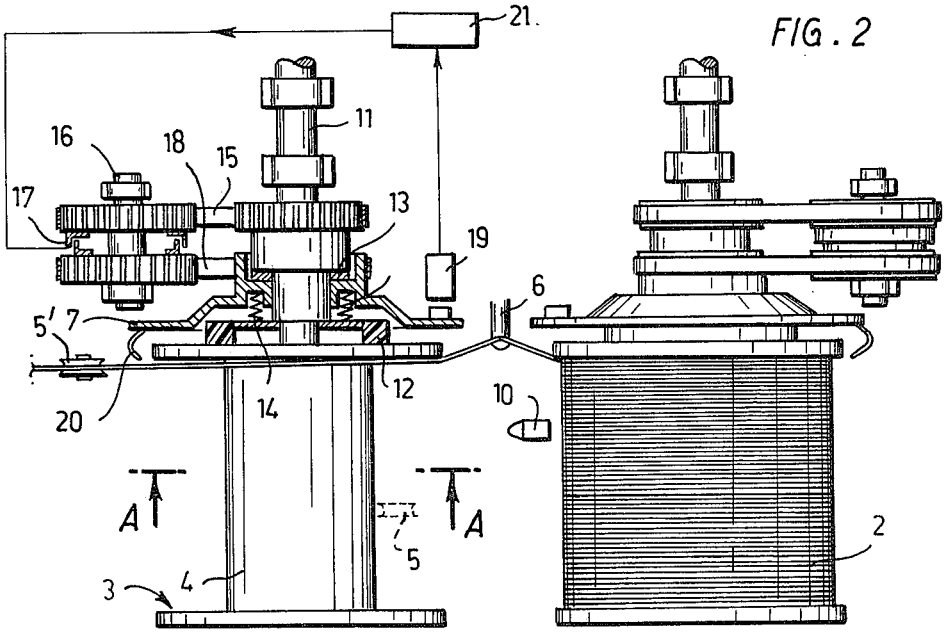
Figure 3:
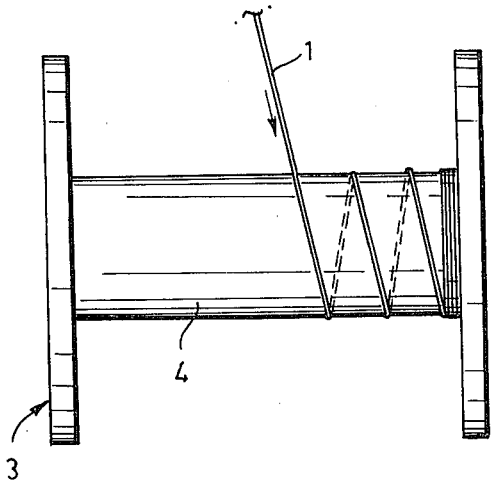
Figure 4:
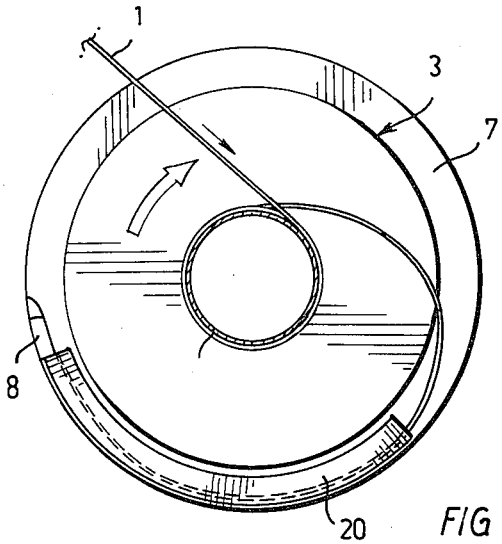

One embodiment of the invention will be described in more detail in the following with reference to the accompanying drawings, in which FIG. 1 is a front view of an arrangement of the reels in a double-winding device and of the principle for shifting the wire FIG. 2 is a top view of the arrangement of the reels in a double-winding device, of the wire shifting principle and of the mechanisms for rotating the shifting flange and the reel, FIG. 3 illustrates the distribution of wire on the reel immediately after shifting the wire, and FIG. 4 is a section along line A—A in FIG. 2 illustrating the manner in which a long end is formed in the wire.

FIG. 2 shows the mechanism for rotating a reel 3 and a shifting flange 7. The reel 3 is rotated by means of a motor (not shown in the Figure) through a reel shaft 11 and through a friction flange 12 engaging the reel flange by means of a friction surface. The friction flange 7 normally rotates at the rotation speed of the reel through a friction clutch 13 connected to the reel shaft 11. The capability of the friction clutch to transmit torque is adjustable by means of springs 14.

FIGS. 1 and 2 illustrate the automatic shifting of the wire 1 from a full reel 2 to an empty reel 3. The shifting operation is preceded by a preparatory operation during which the empty reel is actuated so that the speed $V_R$ of a drum 4 is equal to the speed $V_L$ of the wire 1. A wire distributor 5 is displaced towards the side adjacent the empty reel 3 to a point 5' where it is tangent to the drum of the empty reel 3. Hereupon a finger 6 presses the wire 1 against a shifting flange 7 whereby the wire 1 passes into a gripper element 8 in the shifting flange 7 and engages with said element. The engagement of the wire on the side of the full reel 2 is prevented. After the engagement, the wire is cut off between the gripper element 8 and the full reel 2, and the winding is continued onto the empty reel 3.

When applying the wire shifting principle described above, a free wire end having a length of only about 50 to 100 mm is obtained, which in many cases is insufficient. By means of the apparatus according to the invention a considerably longer free wire end is obtained as follows:

When a finger 6 shifts the wire 1 and presses it against the shifting flange 7, it presses at the same time a limit switch 9 which transmits a signal to the distributor 5 to distribute wire onto the drum of the empty reel 3 at a very high pitch (FIG. 3). When the distributor 5 has distributed a first wire layer on the reel, its speed is reduced to the normal level. When the distributor 5, while distributing a second wire layer, is located at a distance of about 100 mm from the shifting flange 7, the distributor 5 presses a micro-switch 10. This actuates a time-lag (slow-operating) relay (located in an electrical switch cabinet, not shown in the drawing), which is regulated so as to operate when the distributor 5 is located at a distance of about 10 mm from the shifting flange 7. The time relay connects by means of an electro-magnetic switch 17, a gear mechanism in order to produce the required lag of the shifting flange 7 in relation to the reel 3. The gear mechanism comprises a gear belt transmission 15, an auxiliary shaft 16, a gear belt transmission 18, and a revolution counter 19 for the shifting flange. The gear ratios of the gear belt transmissions 15 and 18 differ slightly from each other, so that the gear ratio of the gear belt transmission 18 is less than 1 percent higher than that of the gear belt transmission 15.

The primary gear of the gear belt transmission 15 is fastened to the reel shaft 11, while the secondary gear is mounted freely rotatably in relation to the auxiliary shaft 16. The electro-magnetic switch 17 is fastened to the secondary gear of the gear belt transmission 15 and to the primary gear of the gear belt transmission 18, said primary gear being fastened to the auxiliary shaft 16. The secondary gear of the gear belt transmission 18 is fastened to the shifting flange 7.

As the electro-magnetic switch 17 connects the gear belt transmission 18 with the gear belt transmission 15, the shifting flange 7, due to the small difference between the gear ratios of said gear belt transmissions, starts to rotate at a lower speed than the reel 3, while the friction clutch 13 is sliding. When the lag of the shifting flange has reached a constant magnitude with respect to each revolution of the reel 3 or the shifting flange 7, said magnitude of the lag can be observed by counting said revolutions by means of a counter 19 after said connection of the gear mechanism until the required lag has been obtained and the counter 19 transmits an information to a control unit 21 that the required number of revolutions has been achieved, whereupon the control unit, by means of the switch 17, disconnects the gear mechanism. At this stage, a wire loop according to FIG. 4 has been formed (in FIG. 4, the lag is illustrated as 180°), which loop, under the action of the centrifugal force caused by the rotation of the reel 3, is pressed into a wire groove 20 where it is protected during winding. At the same time as the gear mechanism id disconnected, the distributor is engaged to distribute wire onto the reel over the entire distance between the reel flanges.

When the required wire length has been wound on the reel, the wire is again shifted over th an empty reel in the manner described above, and the full reel is stopped. After the reel has stopped, the free end of the wire loop is loosened from the gripper element and the reel can be removed from the winding device.

The drawings and the description associated thereto are, of course, only intended to illustrate the idea of the invention. The embodiments of the invention, may, however, vary considerably within the scope of the claims.

What we claim is:

1. In an apparatus for forming a long leading end to a wire when winding the wire on reels including a reel mounted on a reel shaft, means for rotating the reel shaft, a shifting flange for shifting the wire from another reel to said reel, said flange being mounted for rotation concentrically with said reel and adjacent to a flange of the reel, a gripper element on said shifting flange for gripping the wire and means for causing the rotational speed of the shifting flange to lag behind the rotational speed of the reel to create the leading end, the improvement comprising a friction clutch for transmitting rotary motion from the reel shaft to the shifting flange but that permits the flange to slide relative to the shaft, an auxiliary shaft mounted apart from and parallel to the reel shaft, first gear means connecting said reel shaft with said auxiliary shaft and second gear means connecting said auxiliary shaft with said shifting flange, the gear ratio of said second gear means being slightly larger than the gear ratio of said first gear means and coupling means for selectively connecting and disconnecting the first gear means with the second gear means whereby the shifting flange rotates at the same speed as the reel when the coupling means are disconnected and at a speed slower than the reel when the coupling means is connected.

2. The apparatus of claim 1 in which the gear ratios between the first and second gear means differ from each other by no more than 1%.

3. The apparatus of claim 1 including control means responsive to revolutions of the shifting flange for disconnecting the coupling means after a predetermined number of revolutions of the shifting flange.

* * * * *